United States Patent [19]

Schulhof et al.

[11] 4,033,061

[45] July 5, 1977

[54] DISPLAY FOLDER

[75] Inventors: Thomas B. Schulhof; Ronald M. Schulhof, both of New York, N.Y.

[73] Assignee: Quadriga Art Co., Inc., New York, N.Y.

[22] Filed: Sept. 4, 1975

[21] Appl. No.: 610,321

[52] U.S. Cl. ..... 40/158 R

[51] Int. Cl.[2] ..... G09F 1/10

[58] Field of Search ..... 40/158 R, 158 B, 104.18, 40/104.19

[56] References Cited

UNITED STATES PATENTS

| | | | |
|---|---|---|---|
| 236,244 | 1/1881 | Nurre | 40/158 R |
| 1,549,389 | 8/1925 | Simon | 40/158 R X |
| 1,917,922 | 7/1933 | Clark | 40/158 R |
| 2,291,173 | 7/1942 | Simpson | 40/158 B |
| 3,099,268 | 7/1963 | Smith | 40/104.19 |
| 3,341,961 | 9/1967 | Shanks | 40/158 R |

FOREIGN PATENTS OR APPLICATIONS

| | | | |
|---|---|---|---|
| 805,199 | 8/1936 | France | 40/158 R |

*Primary Examiner*—John F. Pitrelli

*Assistant Examiner*—Wenceslao J. Contreras

*Attorney, Agent, or Firm*—Darby & Darby

[57] ABSTRACT

A display folder for exhibiting a display, such as a picture, a certificate and the like, the display folder having two panels connected by a center spine for folding together like a book. Preferably, a display is provided in each panel. The display of each panel is sandwiched between a base sheet and a top sheet of substantially rigid material, such as chipboard, with the top sheet adhering to the sheet of display material in space provided between the display and one or more adjacent edges of the display sheet to permit removal of a cut-away portion of the top sheet when the top sheet is cut to provide a frame around the display. The panels are adhesively encased in an overlay cover material. An aperture is die-cut through the top sheet of each panel with the aperture being larger than the display, the inner edge of the aperture being between the display and the adhesion material securing the top sheet to the display sheet, whereby removal of the die-cut material exposes the display, with the remaining portions of the top sheet forming the frame around the display.

12 Claims, 13 Drawing Figures

DISPLAY FOLDER

BACKGROUND OF THE INVENTION

The present invention relates generally to a folder, and more particularly to a display folder for exhibiting a picture, a certificate and the like therein which are permanently secured in the display folder, and the method of making same.

The prior art discloses many ways to hold a picture, certificate and the like in a folder which acts as a carrier piece. In one prior art folder, the picture and certificate are each held separately by four corner ribbons, under which the corners of the picture and certificate are slid. However, this folder has an unfinished look because of the exposed ribbons. Additionally, the process of using such ribbons is slow and costly, where both the picture and certificate must be hand inserted under the ribbons, one at a time. Furthermore, the picture and certificate are not permanently secured in the folder, and therefore may be easily moved or separated therefrom.

An alternative prior art method is to insert the picture and certificate into a slit under a top sheet having a die-cut frame on each of the panels so that the picture and certificate can be viewed. However, the insertion of the picture and certificate into the frame slit is costly, and requires manual insertion thereof. In addition, the picture and certificate must be small enough to get through the slits in order to be inserted, where once they are inserted, there is room for movement therebetween so that the picture and certificate may be moved, knocked askew or tilted during movement or transportation of the folder.

SUMMARY OF THE INVENTION

Accordingly, it is an object of the present invention to provide a display folder and a method of making same which overcomes the disadvantages of the prior art.

It is another object of the present invention to provide a display folder having a picture, certificate and the like permanently encased into the frame of the folder so that the picture, certificate and the like cannot become askew, tilted, etc. during movement or transportation of the display folder.

It is a further object of the present invention to provide a display folder that is simple and inexpensive to manufacture, where the permanent nature of the construction has a psychological attraction.

It is a still further object of the present invention to provide a display folder which is formed as an integral unit giving the appearance of a one-piece arrangement, and thus providing a permanency befitting the use of the folder.

It is an added object of the present invention to provide a display folder as mentioned above, where an aperture is die-cut after the display has been positioned therein, to provide a frame around the display.

And yet another added object of the present invention is to provide a display folder having a picture and certificate therein, which can be used as a remembrance for a deceased person and which can be retained by the deceased's family for many years.

To this end, the present invention relates to a display folder for exhibiting a display, such as a picture, a certificate and the like, the display folder comprising two panels connected by a center spine for folding the panels together like a book, where a display is preferably provided in each panel. The display of each panel is sandwiched between sheets of substantially rigid material by adhering means to permit removal of a cut-away portion of the top sheet when die-cut to provide a frame around each display, each aperture being die-cut through the top sheet of each panel so that the inner edges of the aperture are formed between the display and the adhesion material securing the top sheet to the display sheet for permitting the removal of the die-cut material to expose the display, while the remaining portions of the top sheet form the frame around each display. Preferably, the panels are encased in an overlay cover material.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DETAILED DESCRIPTION OF THE PREFERRED EMBODIMENT

Figure 1:
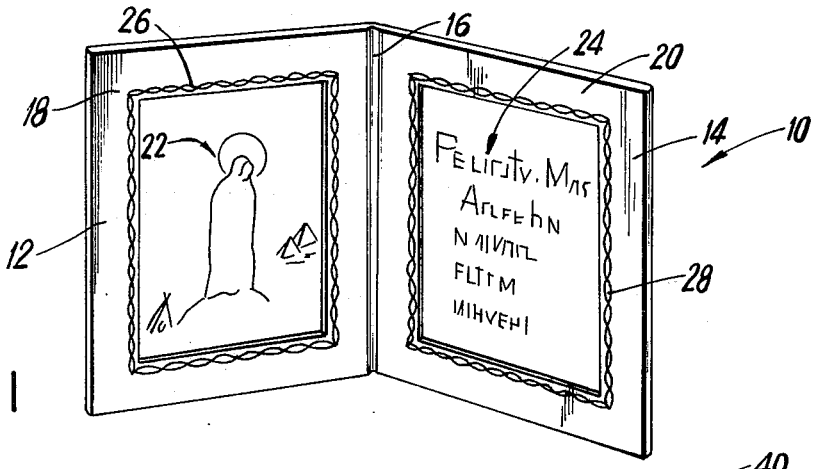
FIG. 1 illustrates a perspective view of a display folder according to the present invention.

Referring now to the drawings, FIG. 1 shows the present invention comprising a display folder generally denoted by the reference character 10. The primary purpose of the folder 10 is for use as a remembrance for a deceased person, which is retained by the deceased's family for many years, so that the permanent nature of the folder 10 has a psychological attraction befitting the use of the folder. The folder 10 includes two cover members 12 and 14 connected together by a spine 16 to permit the cover members 12, 14 to be folded together like a book. The inside pages 18 and 20 of cover members 12 and 14, respectively, are provided with printed displays, such as a picture 22 on page 18 and an enrollment certificate 24 on page 20. Preferably decorative gold stampings 26, 28 are disposed on the pages around each of the displays 22, 24 respectively.

Figure 2:
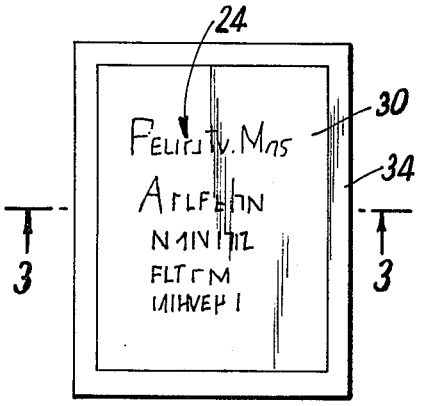
FIG. 2 illustrates a step in the method of making the display folder, showing a top plan view of a display sheet mounted on a base sheet.
Figure 3:
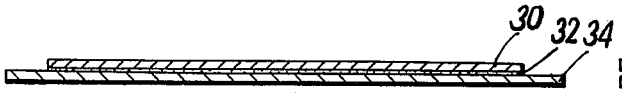
FIG. 3 illustrates an enlarged cross sectional view taken along the line 3—3 in FIG. 2.

FIGS. 2 and 3 disclose an initial operation in the construction of the folder 10. For simplicity, only the method of forming one panel assembly is discussed, but it is understood, that the other panel assembly is formed in a similar manner. The display 24 is printed on a sheet 30 which is only slightly larger than the eventual size of the display 24 which will be showing when the frame is finished. The display sheet 30 is secured by conventional means 32, such as an adhesive material, glue and the like, to a blank piece of chipboard 34 defining a base sheet of substantially rigid material, so that a border is provided around the display sheet 30. The base sheet 34 has already been cut to the finished dimensions of the folder.

Figure 4:
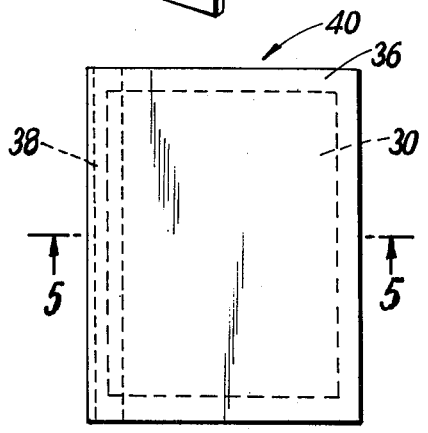
FIG. 4 illustrates another step in the method, showing a top plan view of a top sheet disposed on the display sheet and base sheet.
Figure 5:
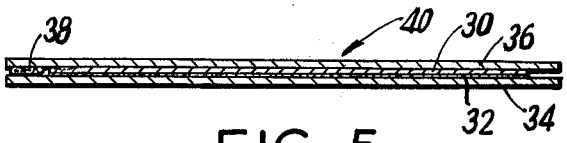
FIG. 5 illustrates an enlarged cross sectional view taken along the line 5—5 in FIG. 4.

Another blank piece of chipboard 36, of the same identical size and material of the chipboard 34, is provided to define a top sheet of substantially rigid material. As shown in FIGS. 4 and 5, the top sheet 36 is disposed over the display sheet 30 and secured thereto by conventional means 38, such as an adhesive material glue or the like. The adhering means 38 is illustrated as being applied as a glue strip along one of the vertical edges of the display sheet 30 and the base and top sheets 34, 36, so that the glue strip 38, in addition to gluing together the display sheet 30 and top sheet 36, also glues together the vertical edge portions of the top and base sheets 36, 34. It will be understood, however, that for reasons more fully provided below, the adhering means may be applied to more than one of the outside edges of the sheet 30, the only limitation being that no adhering means 38 may be applied to the sheet 30 within the area of the display 24.

This gluing operation is an important feature of the present invention, and the glue strip 38 must be applied carefully so that, as noted above no glue is deposited on the display 24 or 22, thereby permitting the overlaid piece of chipboard 36 in the area of the printed certificate 24 or picture 22 to be cut away and not stuck to either the picture 22 or certificate 24, as will be explained hereinafter below in broad detail. Thus, the display sheet 30 having the display certificate 24 thereon is sandwiched between the top sheet 36 and the base sheet 34 to define a panel assembly 40.

Figure 6:
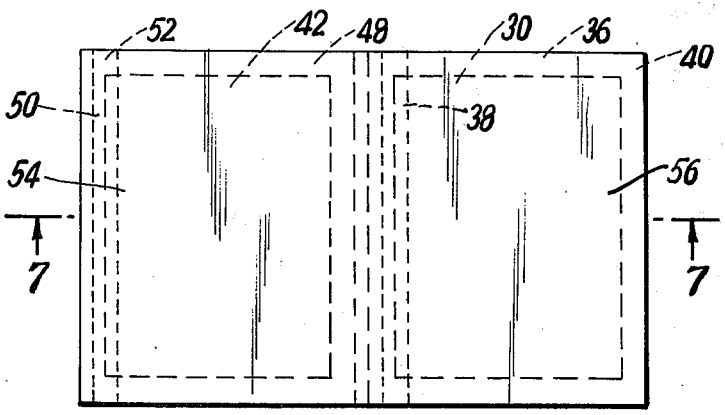
FIG. 6 illustrates a further method step, showing a top plan view of an overlay cover material encasing two adjacent panel assemblies.
Figure 7:
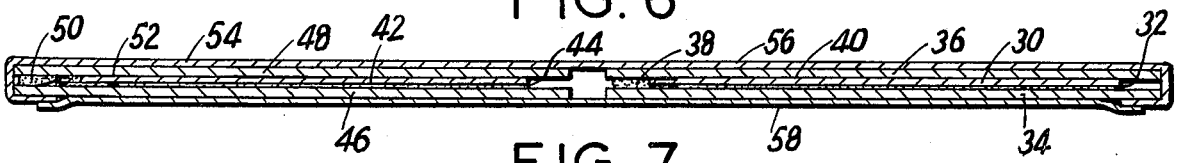
FIG. 7 illustrates an enlarged cross sectional view taken along the line 7—7 in FIG. 6.

By the above-mentioned method, a display sheet 42 having the picture 22 printed thereon, is glued by adhering means 44 to a base sheet 46, as shown in FIGS. 6 and 7. Additionally, a top sheet 48 is secured by a gluing strip 50 disposed along a vertical edge thereof to the corresponding vertical edges of the display sheet 42 and base sheet 46 in the same manner and for the same purpose as mentioned above, i.e., to sandwich the display sheet 42 between the base and top sheets 46, 48 to provide a second panel assembly 52.

The two panel assemblies 40, 52 containing the display sheets 30, 42, respectively, are placed side-by-side as shown in FIGS. 6 and 7, and are machine wrapped in a decorative cover material 54 in a conventional manner well known in the art. The machine wrapping is on all sides and edges, so that the two panels 40, 52 are encased therein with no exposed chipboards 34, 36, 46 and 48. The decorative cover material 54 includes a first overlay material 56 secured by conventional adhesive means to the outer surfaces of the top sheets 36 and 48, and a second overlay material 58 which is secured by conventional adhesive means to the base sheets 34 and 46, and also overlaps the first overlay material 56 as shown in FIG. 7 to provide a finished appearance thereof. Preferably, the central portions of the overlay material disposed between the panel assemblies 40, 52 are not secured together, and define the above-mentioned spine 16 to permit folding of the cover members 18 and 20. The cover material 54 also serves to hold the top sheets 36, 48 and base sheets 34, 46 together.

Figure 8:
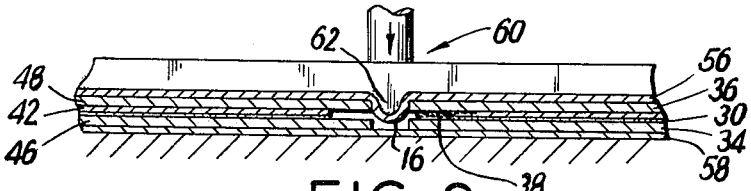
FIG. 8 illustrates a fragmentary cross sectional view showing the step of stamping a decorative imprint on the folder.

Preferably, the next step is to stamp the decorative imprints 26 and 28 onto the surface of the overlay material 56. Preferably, the imprints 26, 28 are decorative gold stampings, which are stamped by a conventional stamping apparatus 60. Additionally, the decorative gold stamping can be applied on the front or rear pages of the folder 10 defined by the overlay material 58, such being performed in a conventional manner. Furthermore, during the stamping operation, the spine 16 can be formed by a protuberance 62 provided on the stamping apparatus 60, as shown in FIG. 8.

Figure 9:
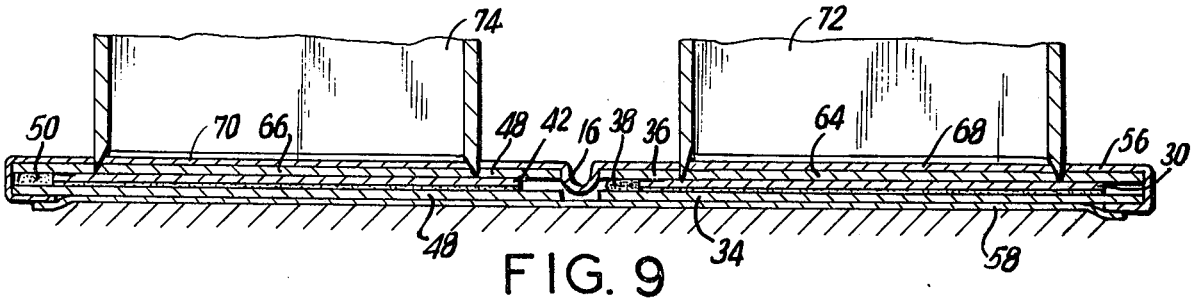
FIG. 9 illustrates a fragmentary cross sectional view showing the step of die-cutting the folder.
Figure 10:
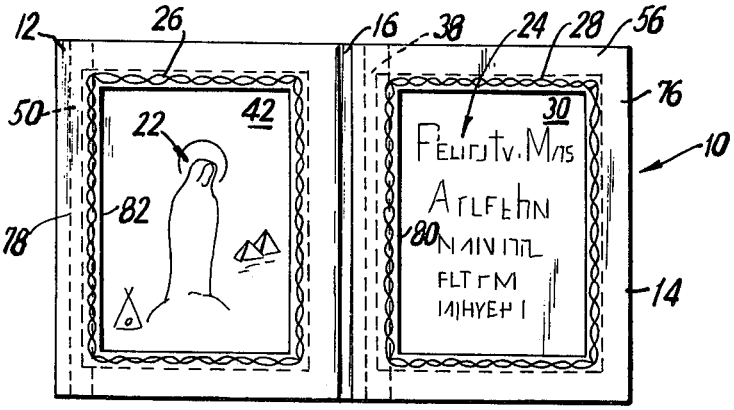
FIG. 10 illustrates a top plan view of the finished folder.

The next step, as shown in FIG. 9, is to die-cut away portions 64, 66 of the top sheets 36, 48, respectively, and those portions 68, 70 of the overlay material 56 which are attached to the top sheet portions 64, 66, respectively. The die-cutters 72, 74 are conventional and well known in the art, where the die-cutting operation can be performed simultaneously as indicated in FIG. 9, or can be performed individually for each top sheet, such depending upon the type of conventional die-cutting apparatus being used in the operation. Accordingly, the die-cut materials 64, 68 and 66, 70 are removed to expose the certificate 24 and the picture 22, respectively, thereby forming the frames 76 and 78 around each of the displays 24, 22, as shown in FIG. 10.

It is now apparent why the positioning of the glue strips 38, 50 is important. Had there been an overall gluing of the top sheets 36, 48 to the display sheets 30, 42, it would not have been possible to free the cut-away portions 64, 66 from the display sheets 30, 42 after the die-cutting operation. Furthermore, as clearly shown in FIGS. 9 and 10, the apertures formed by the die-cutters are larger than the displays 22, 24, where an edge 80, 82 of each aperture is located between the display 24, 22 and the respective glue strips 38, 50, thereby permitting removal of the die-cut material, since no adhesive material was in contact with the displays 22, 24 at any time during the above-mentioned operations.

Figure 11:
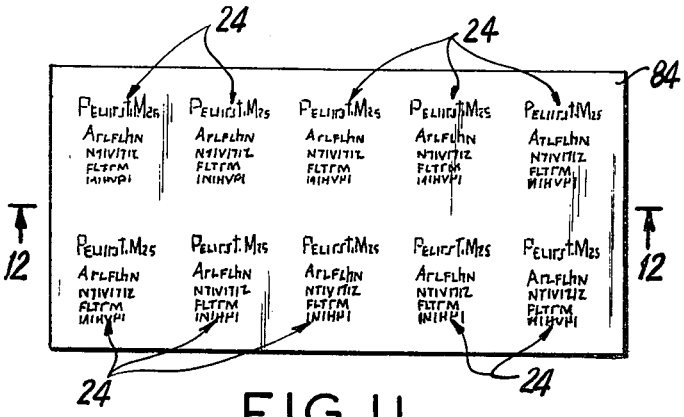
FIG. 11 illustrates a top plan view of a modified step in the method of making the folder, showing a large printed sheet having multiple displays thereon.
Figure 12:
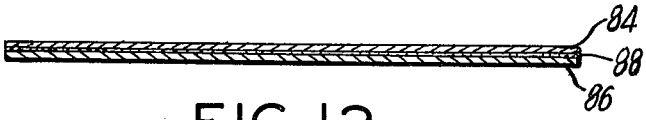
FIG. 12 illustrates a cross sectional view taken along the line 12—12 in FIG. 11.
Figure 13:
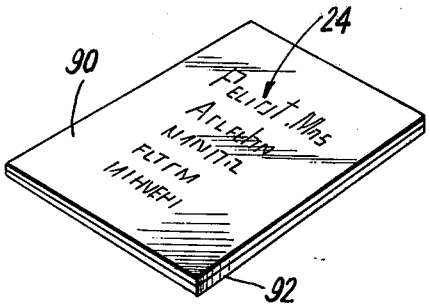
FIG. 13 illustrates an enlarged perspective view of a display sheet cut from the large printed sheet of FIGS. 11 and 12.

FIGS. 11–13 show an alternate method of securing the display sheet to the base sheet, this procedure being the same for both the picture 22 and the certificate 24. As shown in FIG. 11, a large sheet 84 is imprinted with multiple certificates 24, or pictures 22 (not shown). The large printed sheet 84 is then secured to a large base sheet 86 fabricated from chipboard, being secured by conventional means 88 such as an adhesive material or glue, as shown in FIG. 12. The large chipboard 86 and the large printed sheet 84 pasted thereon are then cut to the size of the finished folder, as shown in FIG. 13. Accordingly, the individual display sheet 90 having the certificate 24 thereon, or picture 22 thereon (not shown), is equal to the full size of the cut base sheet 92, and also equal to the full size of the finished folder. The process for forming the folder 10 with the display sheet 90 and base sheet 92 is the same as mentioned above.

Preferably, a specially high gloss paper is used for the printing of the certificate 24. In addition, by the use of a special application of the printing of the picture 22 and certificate 24, it is possible to obtain an even higher gloss, which serves as a substitute for acetate. Thus, this higher gloss makes it unnecessary to use such acetate over the picture or certificate, as is the normal practice in the prior art which uses the ribbon folders and slit insertion folders. Furthermore, it is possible to specially treat the certificate 24 so that it is receptive to ink, so that the enroller's name can be written thereon.

Thus, the above-mentioned unique method of sandwich construction enables the manufacturer to eliminate the hand insertion through the slit or ribbon folder that has heretofore been required. The economic saving of this feature is significant, as is the fact that the cost of the basic construction of the folder is also less expensive than that mentioned in the prior art. The folder of the present invention has a permanency of encasement feature which, in view of the ultimate usage it receives, is considered an attribute.

Because of the method of construction of the present invention, the enclosed picture and certificate are not subject to movement, and the position in which they are glued down are the positions in which they stay. As many of these types of folders are mailed to the ultimate recipients, the fact that the jostling they receive in the mail does not, in the folder of the present invention, effect the position of the picture and certificate, provides an advantage which is not present in the prior art folders.

Numerous alterations of the structure herein disclosed will suggest themselves to those skilled in the art. However, it is to be understood that the present invention relates to a preferred embodiment of the invention which is for purposes of illustration only and is not to be construed as a limitation of the invention.

What is claimed is:

1. A display member comprising a base sheet of substantially rigid material, a sheet of display material having a display on one side thereof, first adhering means securing the opposite side of said sheet of display material to said base sheet, a top sheet of substantially rigid material disposed on said one side of said sheet of display material to sandwich said sheet of display material between said base and top sheets to define a panel assembly, said top sheet having an aperture therethrough larger than said display and smaller than said sheet of display material to define a frame around said display, second adhering means securing said one side of said display material to said top sheet, an overlay cover material completely enclosing said panel assembly and being continuous at the borders thereof, and third adhering means securing said cover material to the entire outer surface of said base sheet and the entire outer surface of said frame portion of said top sheet.

2. A display member as claimed in claim 1, wherein said top and base sheets are fabricated from chipboard.

3. A display member as claimed in claim 1, wherein said panel assembly is disposed in at least one member of a folder, said folder comprising first and second members connected together by a spine to permit said folder members to be folded together with said display positioned inside said folder between said folder members, said overlay cover material being an outer surface of each of said folder members and providing said spine.

4. A display member as claimed in claim 3, wherein said panel assembly is disposed in each of said folder members with said display of each panel assembly facing each other when said folder is in a folded position.

5. A display member as claimed in claim 4, wherein said display in said first folder member is a picture, and the other display in said second folder member is a certificate.

6. A display member as claimed in claim 1, wherein said sheet of display material is slightly smaller than said base sheet.

7. A display member as claimed in claim 1, wherein said sheet of display material is equal in size to said base sheet.

8. A display member according to claim 1 wherein each of said first, second and third adhering means is an adhesive.

9. A display member according to claim 1 wherein said overlay cover material is formed with an aperture therein, said overlay aperture being adjacent to, and coextensive with, said top sheet aperture.

10. A display folder comprising:

first and second folder members, each of said folder members including a base sheet of substantially rigid material, a sheet of display material having a display on one side thereof, first adhering means securing the opposite side of said sheet of display material to said base sheet, a top sheet of substantially rigid material disposed on said one side of said sheet of display material to sandwich said sheet of display material between said base and top sheet, said top sheet having an aperture therethrough larger than said display and smaller than said sheet of display material to define a frame around said display, and second adhering means securing said one side of said display material to said top sheet;

an overlay cover material completely enclosing said first and second folder members and being continuous at the borders thereof, said overlay cover material connecting said first and second folder members and forming a spine therebetween; and third adhering means securing said cover material to the entire outer surface of the base sheet and the entire outer surface of the frame portion of the top sheet of each of said first and second folder members.

11. A display folder according to claim 10 wherein each of said first, second and third adhering means is an adhesive.

12. A display folder according to claim 10 wherein said overlay cover material is formed with first and second apertures therein, each of said overlay apertures being adjacent to, and coextensive with, a respective one of said top sheet apertures.

* * * * *